US007520542B1

(12) United States Patent
Price

(10) Patent No.: US 7,520,542 B1
(45) Date of Patent: Apr. 21, 2009

(54) CHILDPROOF GATE LATCH

(75) Inventor: Elvin C. Price, Dacula, GA (US)

(73) Assignee: ECP Family Properties, LLC, Lawrenceville, GA (US)

( * ) Notice: Subject to any disclaimer, the term of this patent is extended or adjusted under 35 U.S.C. 154(b) by 0 days.

(21) Appl. No.: 11/856,445

(22) Filed: Sep. 17, 2007

Related U.S. Application Data

(60) Provisional application No. 60/825,998, filed on Sep. 18, 2006.

(51) Int. Cl.
*E05C 1/08* (2006.01)
*E05C 3/12* (2006.01)

(52) U.S. Cl. ..... 292/183; 292/130; 292/184; 292/189; 292/230; 292/231; 292/341.15; 292/DIG. 29; 292/DIG. 68; 49/394; 256/65.13

(58) Field of Classification Search ..... 292/130, 292/131, 136, 183, 184, 189, DIG. 29, DIG. 68, 292/137, 230, 231, 238, 341.15, 341.17; 70/97, 98; 49/394; 256/65.13; 403/25, 49, 403/321, 324
See application file for complete search history.

(56) References Cited

U.S. PATENT DOCUMENTS

| | | | | |
|---|---|---|---|---|
| 97,934 | A | 12/1869 | Large | |
| 608,353 | A | 8/1898 | Olst | |
| 727,494 | A | 5/1903 | Thompson | |
| 854,193 | A | 5/1907 | Betts | |
| 939,174 | A * | 11/1909 | Schlapbach | 292/150 |
| 995,232 | A | 6/1911 | Edgar, Sr. | |
| 1,131,403 | A | 3/1915 | Matthews | |
| 1,260,469 | A | 3/1918 | Smith | |
| 1,426,445 | A * | 8/1922 | Anderson | 292/341.13 |
| 1,671,328 | A | 5/1928 | Sturm et al. | |
| 1,768,021 | A * | 6/1930 | Bauerband | 70/282 |
| 1,820,715 | A | 8/1931 | Vance | |
| 2,641,494 | A | 6/1953 | Burris | |
| 2,803,074 | A | 8/1957 | Brokish | |
| 2,861,287 | A * | 11/1958 | Scalf | 15/144.2 |
| 3,282,617 | A * | 11/1966 | Wason | 292/171 |
| 3,953,064 | A | 4/1976 | McHenry | |
| 4,055,360 | A * | 10/1977 | Russi | 292/228 |
| 4,142,749 | A | 3/1979 | Heald et al. | |
| 4,249,345 | A | 2/1981 | Littleton | |
| 4,452,011 | A | 6/1984 | Trombettas | |
| 4,606,145 | A * | 8/1986 | Trombettas | 49/57 |
| 4,630,396 | A | 12/1986 | Zvi et al. | |
| 4,681,354 | A * | 7/1987 | Warwick | 292/37 |
| 4,937,975 | A * | 7/1990 | Zilkha | 49/56 |
| 5,020,834 | A * | 6/1991 | Zilkha | 292/74 |
| 5,174,063 | A * | 12/1992 | Lewis et al. | 49/141 |
| 5,873,198 | A * | 2/1999 | DeMario | 49/67 |
| 6,398,445 | B1 * | 6/2002 | Matali Badia | 403/109.6 |
| 6,481,158 | B1 * | 11/2002 | Marks | 49/57 |

* cited by examiner

*Primary Examiner*—Carlos Lugo
(74) *Attorney, Agent, or Firm*—Womble Carlyle Sandridge & Rice, PLLC

(57) ABSTRACT

A childproof gate latch for an enclosure such as a fence is provided with a latching member attached to a gate. The latching member is received through a lock opening in a fence support as the gate is closed. A latching sleeve is moveable into engagement with the latching member as the latching member enters the lock opening. Thereafter, as the latching sleeve is raised and the latching member released from engagement, a pawl moves to a lowered position supporting the latching sleeve in a ready to engage arrangement.

2 Claims, 4 Drawing Sheets

CHILDPROOF GATE LATCH

CROSS-REFERENCE TO RELATED APPLICATIONS

This application claims the benefit of U.S. Provisional Application Ser. No. 60/825,998, filed Sep. 18, 2006, entitled "Childproof Gate Latch," the entire contents of which is hereby incorporated by reference as if presented herein in its entirety.

FIELD OF THE INVENTION

The present invention generally relates to fencing, and in particular to a child-proof gate latch assembly for restricting access through a fence gate by children.

BACKGROUND OF THE INVENTION

Many homes and businesses today generally have fences around a portion of their property. For example, for homes with pools in their backyards, many state laws mandate fences be erected surrounding the area about the pool to restrict access thereto by children and unauthorized third parties. Most fences do, however, include a gate to enable access to the enclosed area from outside the fence. Many fence gates are secured with a latch or similar closure mechanism that typically includes a hook or latch bar that engages and is captured within a corresponding latching mechanism mounted on a fence post adjacent the gate.

Additionally, it generally is desirable that the latching mechanisms for most conventional fence gates be accessible from one or both sides of the fence in order to enable opening of the gate as needed. For example, many gates will have a handle on one side or the other side of the gate that has a mechanism to engage and open the latch to enable opening of the gate. The problem that exists with such conventional gate latch assemblies, however, is that the necessity for such latch assemblies to be accessible and easy to use also makes them accessible and easy to use by children. This can pose potential dangers such as when children open the gate and gain access to a backyard pool without supervision or put themselves in danger by being attacked by animals such as guard dogs or otherwise being injured when they trespass in dangerous areas.

A simple solution generally has been to lock the gate with a padlock, key lock or similar locking mechanism. However, this severely restricts access through the gate, requiring that those persons needing and authorized to have access to the enclosed, fenced area have a key or know the combination for the lock. In addition, locking the gate back after each use often is not consistently done by the users, either because they forget, the lock malfunctions, or they need continued access and therefore it is not practical to lock the gate. For example, for businesses such as car lots, etc. having fenced-in lots or storage areas, it is often not practical for them to lock the gate for such areas every time a user enters or exists the gated area. Likewise, for homeowners who desire or need more frequent passage into their fenced-in areas, such as for access to their backyard by a yard service, it is not practical to lock the fence gate after every use.

Accordingly, it can be seen that a need exists for a child-proof gate latch assembly that addresses the foregoing and other related and unrelated problems in the art.

SUMMARY OF THE INVENTION

Briefly described, the present invention generally relates to a gate assembly and a child proof latch assembly therefore, for use with a fence or other, similar type of enclosure. The gate assembly generally will include a gate having a frame that is pivotally attached via one or more hinges to a first fence support, with the gate being swingable from an open position to a closed position locked against a second fence support. A latching member, such as a pin, rod, or other, similar device, which also can include a notch or other recess formed therealong, will be attached to the frame of the gate and generally is sized to be received within a latch opening formed in the second or latching fence support as the gate is swung to its closed, locked position.

The second fence support generally comprises an elongated, hollow post defining an inner channel therealong. A latching sleeve is slidably received within the inner channel of the post, with the lower end of the latching sleeve adapted to engage and secure the latching member within the latch opening of the post when the latching sleeve is in a lowered, locking position. Additionally, a cap generally is positioned adjacent the upper end of the post and engages the upper end of the latching sleeve so as to cause movement of the latching sleeve to a raised, unlocking position out of engagement with the latching member. For example, the cap can be attached directly to the upper end of the latching sleeve so that as the cap is lifted or raised, the latching sleeve likewise is raised out of engagement with the latching member. Alternatively, the cap can be rotatable into or out of engagement with the latching sleeve for raising the latching sleeve, and/or can engage a biasing member attached to the latching sleeve and to the post, so as to urge or force the latching sleeve upwardly in response to the downward movement of the cap.

A pawl further will be pivotally mounted within the inner channel of the post. The pawl generally will include an elongated body having a forwardly projecting portion that is adapted to engage and bear against the inner wall of the post when in a lowered position. In such a position, the latching sleeve rests upon and is supported by the pawl so as to prevent the latching sleeve from engaging the latching member, thus allowing the latching member and the gate to be swung outwardly from the post. The pawl further generally is made from a metal material such as steel or other, similar heavy material, and additionally can be weighted, in order to urge the pawl to a lowered position as the latching sleeve is raised out of engagement with the latching member. As a result, with the pawl in its lowered position, the latching sleeve automatically is placed in an unlocked, ready to engage position. As a further result, as the gate is shut and the latching member received through the latch opening formed in the post, the pawl is moved back to its raised, non-engaging position, which enables the latching sleeve to drop into engagement with locking member.

Various features, objects, and advantages of the present invention will become apparent to those skilled in the art upon a reading of the following detailed description, when taken in conjunction with the accompanying drawings.

DESCRIPTION OF THE INVENTION

Figure 1:
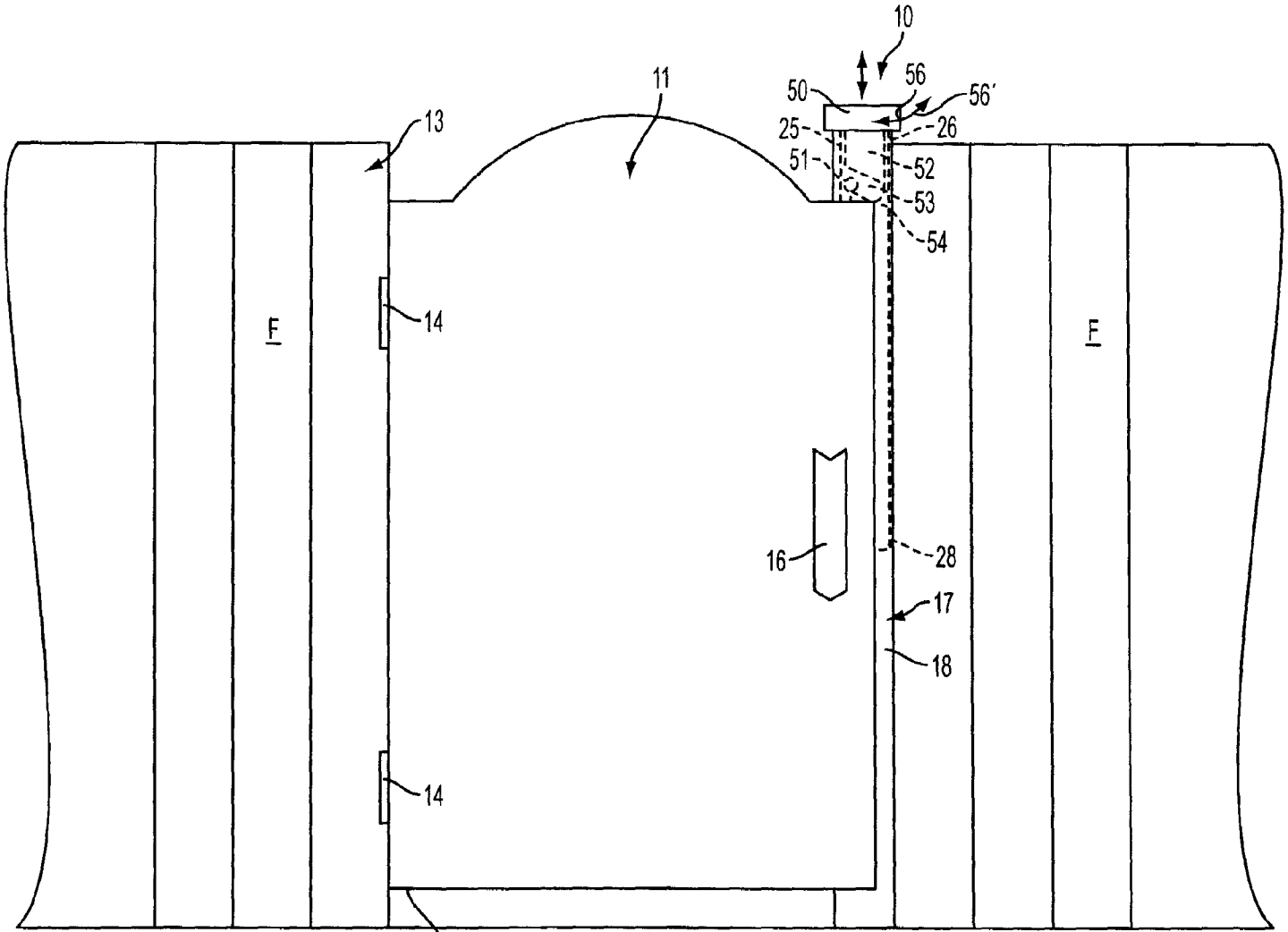
FIG. 1 is a side elevational view illustrating a gate and fence incorporating the childproof gate latch assembly of the present invention.

Referring now to the drawings in which like numerals indicate like parts throughout the several views, FIGS. 1-6 illustrate generally the present invention, which is directed to a childproof latch assembly for doors or gates such as fence gate 11 illustrated in FIG. 1, for enclosures such as a fence F for surrounding a pool, secure enclosure, or other area. The childproof latch assembly 10 of the present invention can be utilized with a variety of different types of doors, gates, partitions, and/or fence assemblies, including metal, plastic/synthetic, or wooden fencing, and can be used in a variety of environments. As generally illustrated in FIG. 1, typically, the gate 11 or door includes a frame or body 12 mounted along on side a first fence post or support 13, usually by two or more spaced hinges 14 attached to both the fence post and the gate. The gate further can include a handle 16 for ease in opening and closing the gate, and additionally can be spring-biased toward a closed position, such as through the use of one or more springs attached to the frame of the gate and the fence F, or through the use of spring-loaded hinges 14 that tend to urge the gate toward a closed position. Still further, a key lock (not shown) or other, similar mechanism also can be built into the handle 16 for added security.

As indicated in FIG. 1, the childproof latch assembly 10 of the present invention generally will be mounted within or formed as a part of a second or latching fence post or support 17 located on the latching side of the gate, opposite from the first fence post/support 13 to which the gate hinges 14 are mounted. As generally illustrated in FIGS. 2A-6, the second or latching fence support 17 will comprise a hollow post or beam, typically formed from a rigid, durable material such as steel, although other materials also can be used. The latching fence support 17 generally will have a substantially cylindrical or box-shaped wall 18 defining a hollow inner channel or passage 19 that extends substantially along its length between an upper end 21 and a lower end 22 of the latching fence support 17.

Figure 2B:
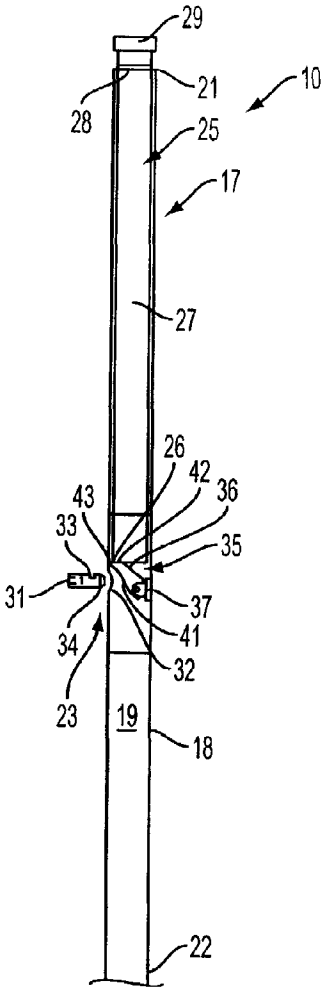
FIGS. 2A-2B are side elevational views illustrating the engagement of the latching member with the latching sleeve of the gate latch assembly of the present invention.
Figure 2A:
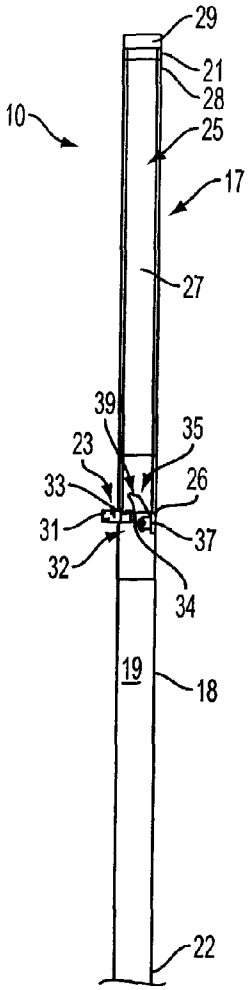

As indicated in FIGS. 2A-2B, a latching sleeve 25 generally will be received within the hollow inner channel 19 of the latching fence support 17. The latching sleeve 25 extends and is slideable along the channel 19 from the upper end 21 of the latching fence support 17 to an approximate midpoint 23 therealong, and typically is formed with a width/length and diameter (or cross section) that is less than the internal diameter or cross-section of the latching fence support 17. The latching sleeve further generally will have a configuration similar to that of the latching fence support so as to be able to slide easily along the inner channel of the latching fence support, as indicated in FIGS. 2A-2B, between a raised, non-engaging, or rest position and its lowered, engaged or latched position for unlatching and latching the gate to the fence. The latching sleeve further will be of a weight, or can have an additional weight applied thereto, sufficient to not only urge and generally maintain the locking sleeve in its lowered, locking position as shown in FIG. 2A, but also will provide a desired amount of resistance to movement that must be overcome before the locking sleeve can be raised to unlock the gate as discussed below.

Figure 4:
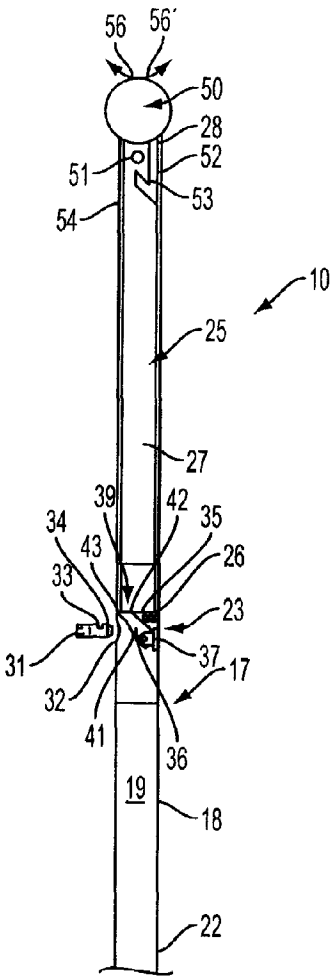
FIG. 4 is a side elevational view showing another embodiment of the childproof latch assembly of the present invention having a rotatable cap.

The latching sleeve 25 generally will be formed as a hollow tube and can be formed from a high strength material such as steel or other metal, or can be formed from various synthetics, plastic, or other rigid, durable materials. The latching sleeve will include a lower end 26 that opens into an open-ended internal channel or recess 27, and an upper end 28 attached to a cap 29 that fits over the top of the upper end of the fence post as shown in FIGS. 1 and 4.

The cap 29 can be formed as a decorative cap, having an appearance similar to other decorative pieces applied to the tops of the other posts of the surrounding fencing, so as to provide a matching, decorative appearance to the rest of the fence, or can be formed as a handle or with various other configurations or shapes as needed or desired for ease of use. The cap further can be weighted to provide additional mass or weight as needed to provide the desired amount of resistance to movement of the latching sleeve required for unlocking or unlatching the gate.

As FIGS. 2A-3B illustrate, a latching member 31 is received within a lock or latch opening 32 that is formed in the latching fence support 17 at its approximate midpoint 23, adjacent the lower end 26 of the latching sleeve 25. The latching member 31 typically is a substantially cylindrical or rectangularly shaped rod or bar that is attached to the gate, either directly or by an extension piece or strut, so as to move with the gate, and is received through the lock/latch opening 32 formed in the latching fence support 17 as the gate is swung to its closed, locking position. The latching member further typically includes a recess, notch, slot, or catch portion 33 formed adjacent its tip or distal end 34.

Figure 3A:
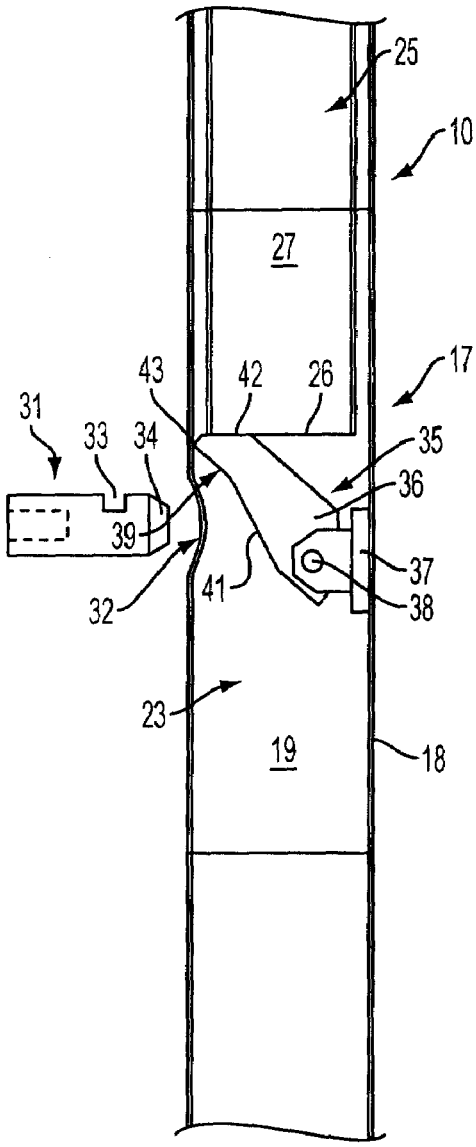
FIGS. 3A-3B are side elevational views illustrating the engagement of the pawl with the latching sleeve to maintain the latching sleeve in a raised, ready-for-latching position.
Figure 3B:
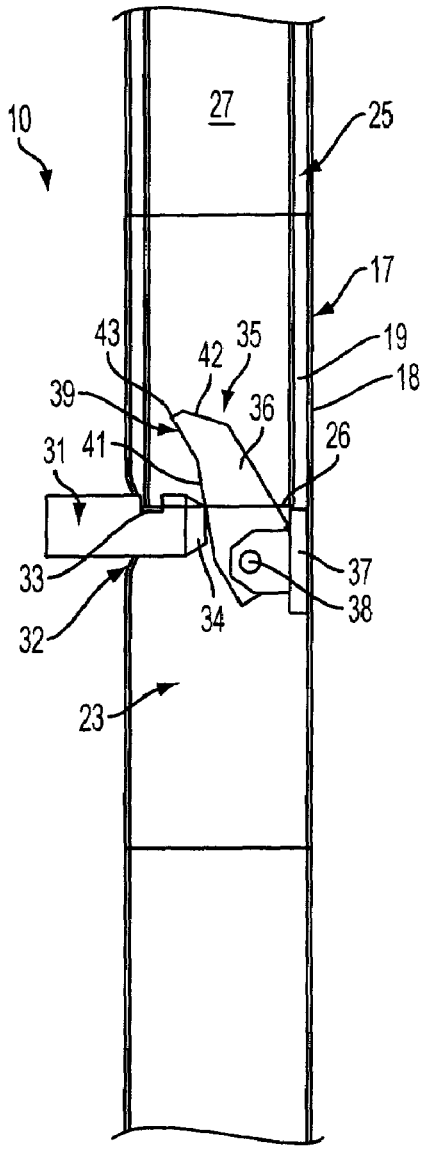

As indicated in FIGS. 2A-2B and 3A-3B, as the latching member is passed through the lock opening 32, it engages a pawl 35 that is pivotally mounted within the inner chamber or channel 19 of the latching fence support 17. The pawl 35 generally includes a body 36 pivotally mounted within a clevis 37 attached along the inner wall of the channel 19 by a pivot pin 38, and has an angled or sloped forwardly projecting portion 39. This forwardly projecting portion 39 includes an angled front surface 41 and a substantially flat top surface 42 that come together at a tip or point 43. Accordingly, as the front surface 41 of the pawl is engaged by the latching member, the front end or tip 34 of the latching member tends to slide therealong and accordingly urges the pawl to a raised, upwardly pivoted position as indicated in FIGS. 2A and 3B. As the pawl 35 pivots upwardly and away from its position supporting the lower end of the latching sleeve, the latching sleeve is allowed to drop or move downwardly into engagement with the latching member, with the lower end 26 of the latching sleeve 25 being received within the recess or notch formed along the upper side of the latching member as shown in FIG. 3B. The gate 11 (FIG. 1) is thus secured to the latching fence support 17 in a closed and latched configuration to prevent access therethrough.

Thereafter, to open the gate, the user pulls or otherwise urges the cap 29 attached to the latching sleeve 25 (FIGS. 2A-3B) upwardly, as indicated in FIG. 2B. This causes the latching sleeve to be moved to its raised, non-engaging position, which in turn releases the latching member 31 from its latched or locked engagement with the latching sleeve within the latching fence support (FIGS. 2B and 3B) to enable the gate to be pivoted or swung to its open, unlatched position. In addition, as further illustrated in FIGS. 2B, 3A, and 4, as the latching sleeve 25 is raised, the pawl 35 generally is urged or enabled to swing downwardly by its own weight, so as to pivot into a lowered, blocking position, with the front edge or tip 43 of the pawl engaging the side wall 18 of the latching fence support 17. With the pawl 35 in its lowered, blocking position, the latching sleeve rests upon and is supported by the upper surface 42 of the forwardly projecting portion 39 in a raised, unlocked and ready to engage position as indicated in FIG. 3A, and the movement of the pawl can also help urge the locking member out of the lock opening 32. As a result, the childproof latch assembly of the present invention is placed in an open, read-to-latch or ready to engage position such that as the gate thereafter is swung back to its closed position, the childproof latch assembly of the present invention will automatically re-latch or lock, without requiring further action by the user to raise the latching sleeve 25 and thereafter replace it in a lowered or engaging position once the latching member has been received within the lock opening of the latching fence support.

FIG. 4 illustrates a further embodiment of the present invention in which a cap 50 is rotatably received within the upper end 28 of the latching sleeve 25. In this embodiment, the latching sleeve is not directly connected to the cap 50, but rather includes a cam pin, rod, or similar engaging member 51 mounted adjacent its upper end 28. The cap 50 further includes a downwardly projecting sleeve or connector 52 received along the channel 27 of the latching sleeve 25. A recess, slot, notch, or other opening 53 generally can be formed in the connector 52 of the cap 50 adjacent a lower end 54 thereof and is adapted to engage the pin 51 of the latching sleeve 25 as the cap is rotated in the direction arrow 56, and release such engagement upon rotation of the cap in the direction of arrow 56'.

In use, the cap 50 (here shown as a ball, although it will also be understood that other configuration also can be used) generally will be rotated in the direction of arrow 56 so that its slot or notch 53 engages the pin 51 of the latching sleeve 25. Once the pin has been engaged, the cap then can be pulled upwardly so as to move the latching sleeve upwardly to its raised, unlocked position out of engagement with the locking member 31. Thereafter, to release the latching sleeve, the cap can be disengaged from the latching sleeve by allowing the cap to be lowered and rotated in the direction of arrow 56', so that its slot or recess is moved out of engagement with the pin 51. Such rotation of the cap can be accomplished manually or can be urged or assisted by a spring or other biasing element, or by the design of the notch or slot 53 to cause the cap to naturally rotate back to its unengaged or unlocked position. The use of such rotating cap accordingly can provide a further security to the childproof latching assembly 10 by preventing the engagement and lifting of the latching sleeve simply because the cap itself is lifted.

Figure 5:
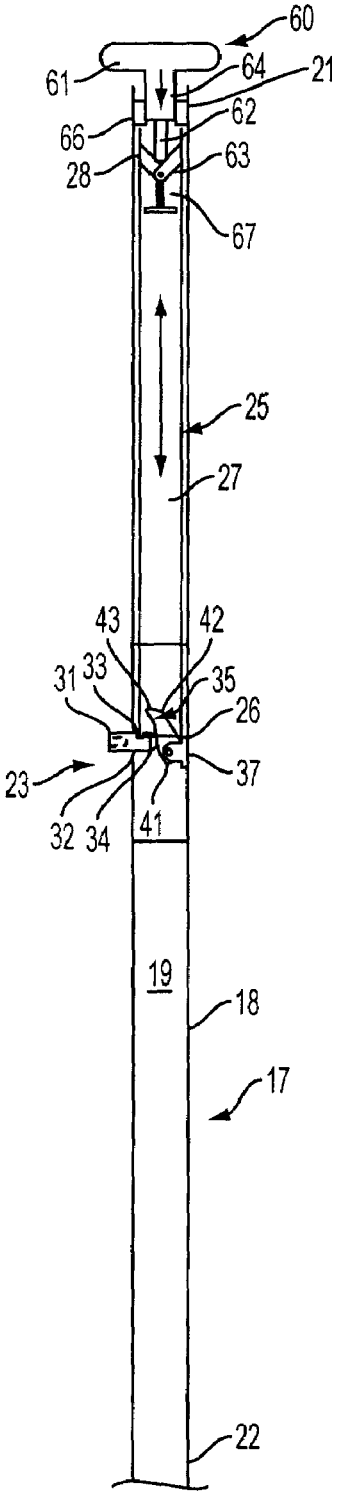
FIG. 5 is a side view illustrating a further embodiment of the childproof latch assembly of the present invention.

Another embodiment of the childproof latching assembly for the present invention is generally illustrated in FIG. 5. In this embodiment, the cap 60 is provided with a plunger type configuration, including an upper portion 61 with a push rod 62 mounted to and projecting downwardly therefrom. As indicated in FIG. 5, the push rod 62 can engage a linkage 63 connected to the upper end 28 of the latching sleeve 25 so as to cause the latching sleeve to be urged upwardly in response to the downward movement of the cap 60 in the direction of arrow 64. Alternatively, the linkage can be formed as a pulley system or can utilize a biasing member such as a spring, elastic band, or cable attached to the latching sleeve and to portions of the inner wall of the latching fence support 17 such that as the cap is pressed downwardly against the biasing member, it will tend to urge the latching sleeve upwardly. Still further, as indicated in FIG. 5, one or more springs or other biasing mechanisms 66/67 can be mounted below the upper portion of the cap and/or below the engagement point between the push rod 62 and the linkage 63 so as to generally bias the cap upwardly and possibly further urge the locking sleeve downwardly into its engaged and locked position.

Figure 6:
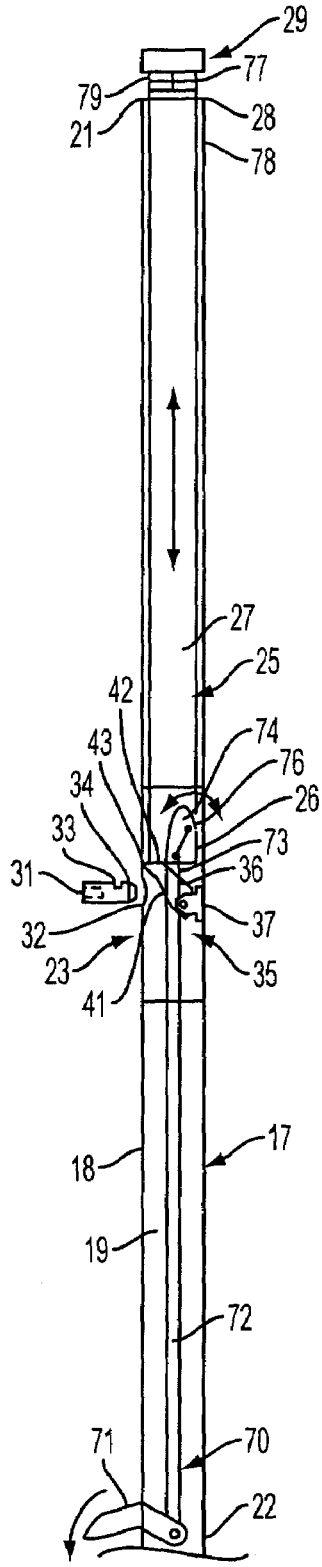
FIG. 6 is a side elevational view illustrating the childproof latch assembly with an additional latch mechanism provided.

FIG. 6 illustrates yet another potential embodiment of the childproof latching assembly according to the present invention. In this embodiment, the childproof latching assembly 10 can be provided with a further locking or security mechanism 70 in the form of a foot engagable lock mechanism. With such a mechanism, a foot pedal 71 can be pivotally attached to a connector linkage 72 that extends upwardly through the internal passage or channel 19 of the latching fence support 17 to a distal or upper end 73. A pivoting catch mechanism or hook 74 generally will be pivotally attached to the upper end 73 of the linkage 72 and to the latching fence support 17 so as to be pivotable into engagement with a slot or notch 76 formed adjacent the lower end 26 of the latching sleeve 25, as indicated in FIG. 6. Accordingly, to move the latching sleeve upwardly to its raised, unlocking position, the foot pedal 71 first will need to be engaged so as to cause the catch mechanism 74 to be pivotally out of engagement with the slot 76 of the latching sleeve. Thereafter, the latching sleeve can be lifted by lifting the cap 29 to cause the latching sleeve to be raised to its unlocking position out of engagement with the locking member 31, as discussed above.

Still further, as an additional security feature illustrated in FIG. 6, the cap and/or upper end 28 of the latching sleeve 25 also can be provided with a spring loaded detent 77 that will engage an opening or hole 78 formed in the side wall of the latching fence support 17. The detent generally can be biased into a locking position extending through the hole or opening in the latching fence support 17, and can be adapted to retract inwardly as sufficient force is applied to overcome the force of the spring 79 biasing the detent outwardly, and thus enable the movement of the latching sleeve.

Accordingly, with the childproof latch assembly of the present invention, because the latching sleeve is maintained in a raised position after unlatching the gate, the childproof latch assembly is left in a ready-to-lock configuration or position so that the gate will automatically be re-latched or locked when the gate is closed, without requiring the user to manually relock the gate by raising the latching sleeve, inserting the latching post into the fence post and then lowering the latch sleeve again to complete the latching of the gate. Additionally, since the cap generally will be positioned at a height well above the reach of most young children, the childproof latch assembly provides a safe and secure, yet easily operable latching assembly for use with various type and styles of fence gates. Further, because the cap can be formed as a decorative post cap that can be designed to match the caps of the other posts, or can be required to rotate to engage the latching sleeve for use, it will further provide an unobtrusive latching means that remains hidden to most children and to many potential intruders. As a result, the childproof latch assembly of the present invention thus provides a simple to use, yet generally unobtrusive/hidden but secure latching assembly for gates for fences to prevent unauthorized or undesired access thereto, especially by children.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A latch assembly for gates, comprising:

an outer post;

a latching member received within said outer post;

a latching sleeve slidable along an internal channel of said outer post and adapted to engage said latching member for securing the gate to the outer post, said latching sleeve having a weight sufficient to provide a desired resistance to movement to prevent inadvertent disengagement of said latching sleeve from said latching member;

a pawl pivotable from a raised, non-engaging position when engaged by said latching member into a lowered position for supporting said latching sleeve in an unlocked, ready to engage position after release of said latching member from engagement therewith, wherein said pawl has a weight sufficient to urge said pawl toward its lowered position upon release of said latching sleeve from engagement with said latching member; and a cap mounted to an upper end of said outer post for supporting said latching sleeve within said outer post, and moving said latching sleeve to a raised, unlocking position out of engagement with said latching member.

2. A gate assembly for a fence enclosure, comprising:

a gate having a frame;

at least one hinge attached to said frame and to a first fence support;

a latching member attached to said frame and sized to be received within a latch opening formed in a second fence support; and said second fence support comprising:

a hollow post having an elongated inner channel defined therealong;

a latching sleeve slideably received within said inner channel and having an upper end, and a lower end adapted to engage and secure said latching member within said latch opening when in a lowered, locking position;

a cap positioned adjacent an upper end of said post and adapted to engage said latching sleeve for moving said latching sleeve to a raised, unlocking position out of engagement with said latching member; and a pawl pivotally mounted within said post, said pawl having a forwardly projecting portion adapted to engage said post when said pawl is in a lowered position so as to support said latching sleeve in its raised, unlocking position, wherein said pawl is formed with a weight sufficient to urge said pawl toward its lowered position, and when said pawl is in said lowered position, said latching member is introduced and is adapted to engage said pawl in order to move said pawl from supporting said sleeve and allow said latching sleeve to engage said latching member, wherein said pawl is formed with a weight sufficient to urge said pawl toward its lowered position upon release of said latching sleeve from engagement with latching member.

* * * * *